US006176278B1

(12) United States Patent
Gill et al.

(10) Patent No.: US 6,176,278 B1
(45) **Date of Patent: *Jan. 23, 2001**

(54) BULK BAG HOLDER

(75) Inventors: David R. Gill, Stewartsville, NJ (US); John F. Simonof, Jr., Easton; Keith Sterner, Bath, both of PA (US)

(73) Assignee: Flexicon Corporation, Phillipsburg, NJ (US)

( * ) Notice: Under 35 U.S.C. 154(b), the term of this patent shall be extended for 0 days.

This patent is subject to a terminal disclaimer.

(21) Appl. No.: 09/305,014

(22) Filed: May 4, 1999

Related U.S. Application Data

(60) Provisional application No. 60/084,316, filed on May 5, 1998.

(51) Int. Cl.[7] ..... B65B 3/16
(52) U.S. Cl. ..... 141/114; 141/313; 248/100
(58) Field of Search ..... 248/95, 97, 100; 141/314, 391, 114, 313, 315

(56) References Cited

U.S. PATENT DOCUMENTS

| | | | | |
|---|---|---|---|---|
| 884,798 | | 4/1908 | Cusick et al. . | |
| 915,847 | | 3/1909 | Frye . | |
| 1,140,867 | * | 5/1915 | Bates | 148/95 |
| 1,520,279 | * | 12/1924 | Cytron | 248/95 |
| 1,533,114 | * | 4/1925 | Herman et al. | 248/97 |
| 2,770,439 | * | 11/1956 | Stafford et al. | 248/95 |
| 2,858,051 | | 10/1958 | Cunningham | 222/103 |
| 3,179,268 | | 4/1965 | Hatch | 214/300 |
| 3,269,430 | * | 8/1966 | Belk | 248/95 |
| 3,924,781 | * | 12/1975 | Witte | 248/95 |
| 3,964,630 | * | 6/1976 | Getz | 248/95 |
| 4,054,161 | | 10/1977 | Alack | 141/12 |
| 4,069,993 | * | 1/1978 | Shanks | 248/97 |
| 4,467,845 | | 8/1984 | Strand et al. | 141/10 |
| 4,519,426 | | 5/1985 | Hardy, Jr. | 141/5 |
| 4,541,765 | | 9/1985 | Moore | 414/267 |
| 4,676,284 | | 6/1987 | DeCrane | 141/114 |
| 4,688,371 | | 8/1987 | Hecht | 53/502 |
| 4,810,156 | | 3/1989 | Pendleton | 414/415 |
| 4,927,104 | * | 5/1990 | Miller | 248/97 |
| 5,056,571 | * | 10/1991 | Derby | 141/114 |
| 5,069,596 | | 12/1991 | Mueller et al. | 414/607 |
| 5,102,208 | * | 4/1992 | Joynes et al. | 248/95 |
| 5,191,920 | * | 3/1993 | McGregor | 141/313 |
| 5,320,251 | | 6/1994 | Ellis | 222/105 |
| 5,333,757 | | 8/1994 | Volk et al. | 222/94 |
| 5,400,837 | | 3/1995 | Kelley et al. | 141/10 |
| 5,518,048 | | 5/1996 | Derby | 141/80 |
| 5,558,137 | | 9/1996 | Futerman | 141/44 |
| 5,682,929 | | 11/1997 | Maginot et al. | 141/65 |
| 5,692,868 | | 12/1997 | Riemersma | 414/403 |
| 5,787,945 | * | 8/1998 | Riemersma | 141/314 |

FOREIGN PATENT DOCUMENTS

| | | | |
|---|---|---|---|
| 484328 | 10/1929 | (DE) | 81/147 |

OTHER PUBLICATIONS

Bulk Equipment Systems Technology, Inc. literature entitled "Model BBL Bulk Bag Loaders"—BBL Bulletin 96.

National Bulk Equipment, Inc. literature on "Bag handling", version Jan. 1997.

Taylor Products literature—"It's Supprising What we Pack Into our Systems".

* cited by examiner

*Primary Examiner*—Ramon O Ramirez
*Assistant Examiner*—Jon Szumny
(74) *Attorney, Agent, or Firm*—Volpe & Koenig, P.C.

(57) ABSTRACT

A bag holder comprising a frame assembly, a bag support, an attachment assembly and a control assembly. The frame assembly includes a base assembly with two vertical posts extending upward therefrom. The bag support is mounted on the posts for vertical movement by the control assembly.

8 Claims, 5 Drawing Sheets

BULK BAG HOLDER

This application claims the benefit of U.S. Provisional application Ser. No. 60/084,316 filed May 5, 1998.

BACKGROUND OF THE INVENTION

1. Field of the Invention

The present invention generally relates to a bag holding apparatus. More particularly, the invention relates to a bag holding apparatus which allows easier loading, unloading and movement of bags.

2. Description of the Prior Art

Large bag like containers are often used for the shipment of bulk materials from one location to another. These bulk bags have a capacity ranging from twenty cubic feet up to seventy cubic feet and may vary in size from thirty-five inches wide by thirty-five inches long by twenty-three inches high up to the same width and length bag having a height of eighty-two inches unfilled.

These bags are constructed with bag loops on the top of the bag which are used for transporting the bags from one location to another and also for holding the bags while they are being filled in a filling machine. The bag loops are generally constructed of a strong web-like material which is sewn onto the upper corners of the square bag. The bulk bags also include an upper inlet spout which is connected to a bag filling apparatus provided in conjunction with the holding apparatus. The material to be loaded into the bag is fed through the filling apparatus, through the inlet spout, and into the bag.

Many prior art bag holding devices include hooks for holding the bag loops while the bag is filled. The hooks are mounted on a horizontal frame which is moveably mounted on the holding apparatus frame. Typical holding apparatus frames include either four posts at the corners of the device or two posts at the rear of the device from which the horizontal frame is cantilevered. These prior art devices generally encounter problems in installing and removing the bags from the holding apparatus since the posts often encumber connection of the loops or the inlet spout.

The horizontal frames are generally moved up and down using hydraulics, pneumatics or screw drives. Since these prior art holding devices are generally very bulky, the drive mechanisms must be rather substantial in order to provide the large forces needed to move the horizontal frame. These drive mechanisms are typically limited in their range of motion or must be even more massive. The limited range of motion can be a problem if, for example, it is desired to move the filling apparatus away from the bag after filling to facilitate removal thereof. Additionally, the cantilevered horizontal frames require additional force to overcome the torsional force on the front of the frame.

As such, there is a need for a bag holding apparatus which allows easier loading, unloading and control of a bag.

SUMMARY OF THE INVENTION

The present invention relates to a bag holder comprising a frame assembly, a bag support, attachment means and a control assembly. The frame assembly preferably includes a base assembly with two vertical posts extending upward therefrom. The bag support engages the posts, at the approximate midpoint of each bag support side frame member, for vertical movement by the control assembly. The control assembly preferably includes a cable assembly which is driven by a drive assembly. The attachment means are interconnected to the bag support for connection of a bulk bag thereto.

DETAILED DESCRIPTION OF THE PREFERRED EMBODIMENT

Figure 1:
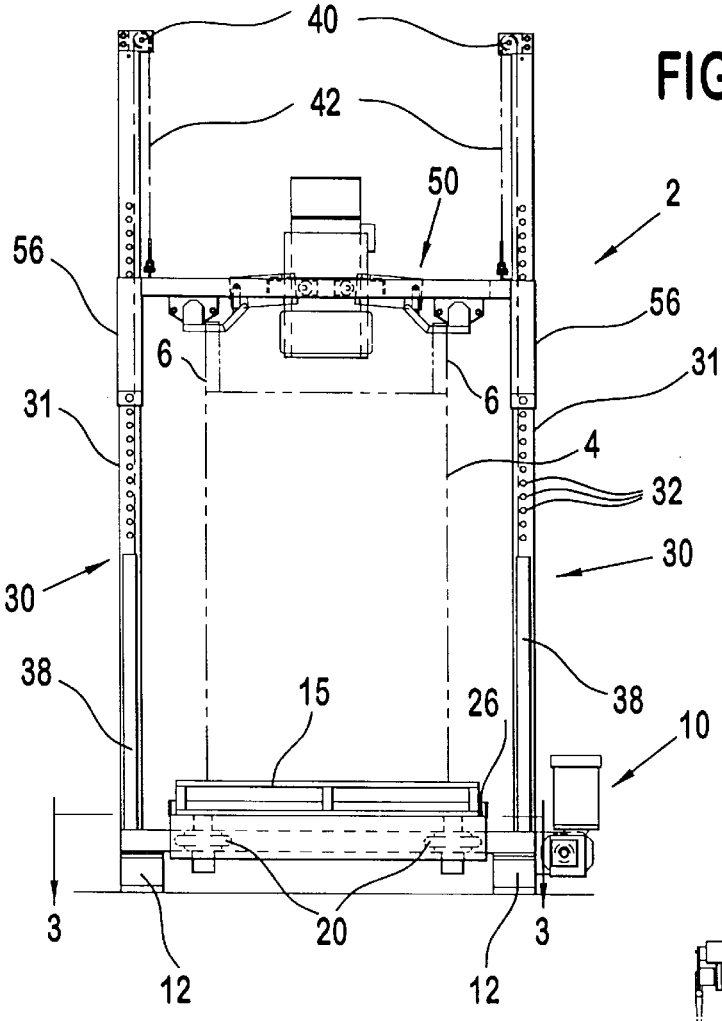
FIG. 1 is an elevation view of the preferred embodiment of the present invention.

The preferred embodiment will be described with reference to the drawing figures wherein like numerals represent like elements throughout.

Figure 3:
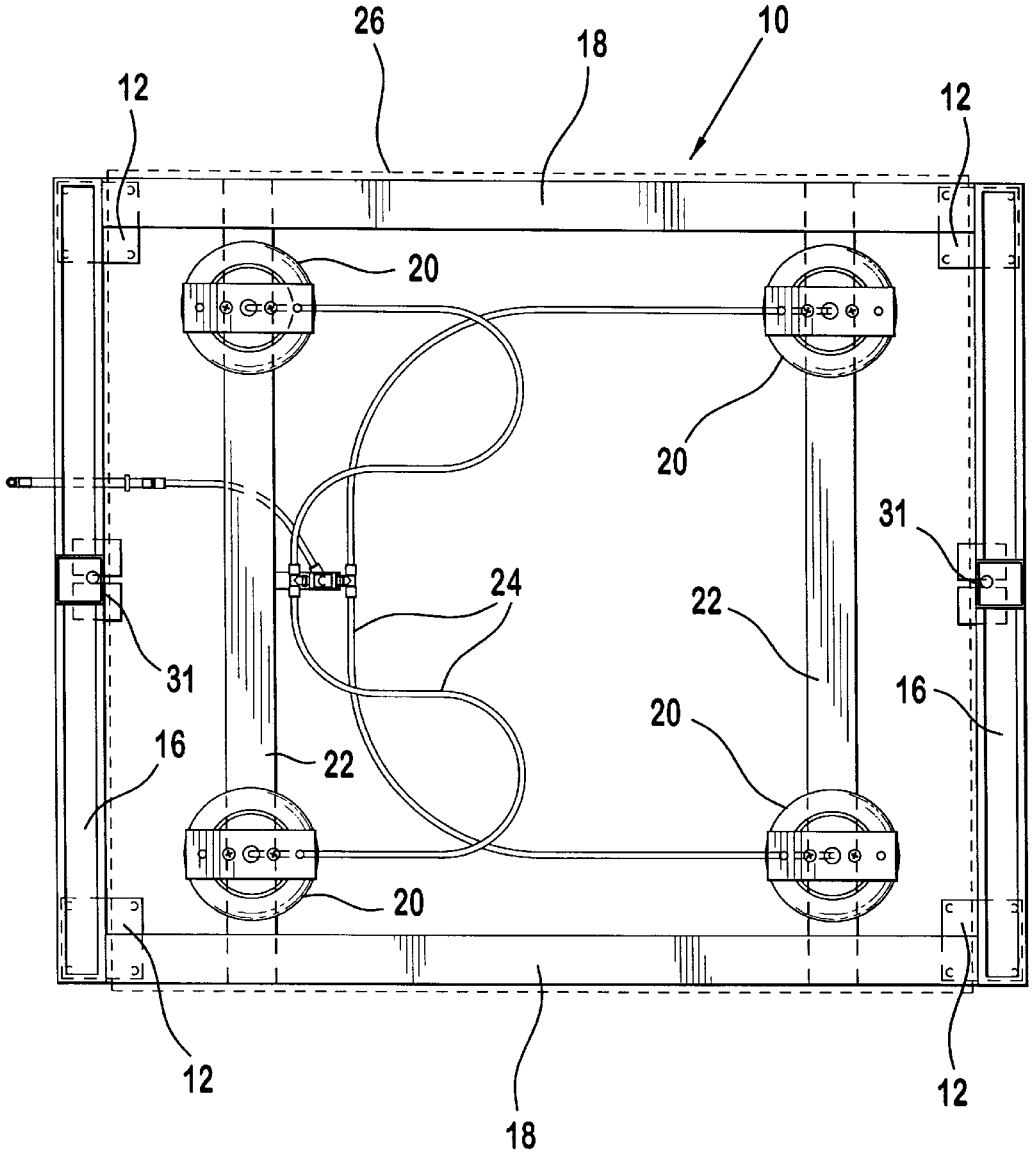
FIG. 3 is a plan view taken along the line 3—3 in FIG. 1.

Referring to FIG. 1, a first embodiment of the bag holder 2 of the present invention is shown. The bag holder 2 generally comprises a base 10, vertical supports 30 and a bag support 50. Base 10 generally comprises longitudinal and transverse frame members 16 and 18, and air spring supports 22, see FIG. 3. The air spring supports 22 extend between and depend from the transverse frame members 18. A number of air springs 20 are positioned at various locations on the air spring supports 22. The air springs 20 are preferably joined together by pneumatic tubing 24.

A platform 26 (shown in phantom in FIG. 3) is positioned on the air springs 20 and may be raised and lowered thereby. The platform 26 is preferably provided with a vibrating mechanism (not shown), whereby vibration of the platform 26 vibrates the bag to deaerate and densify the loaded material. By raising the platform 26 with the air springs 20 prior to vibration, the vibration can be concentrated on the bag 4 and away from the remainder of the bag holder 2. The air springs 20 may also be used to tamp the platform 26 into a suspended bag or raise and drop a bag resting on the platform 26 to provide additional packing of the material.

Base 10 preferably sits on load cells 12 which measure the total weight of the bag 4 and the structural unit. The weight of the bag 4 can then be determined by subtracting the weight of the structural unit from the weight determined by the load cells 12.

Bags 4 preferably rest on a pallet 15 loaded onto the platform 26, but may be positioned directly on the platform 26. The pallet 15 allows a filled bag to be removed from the device 2 with a forklift.

Figure 2:
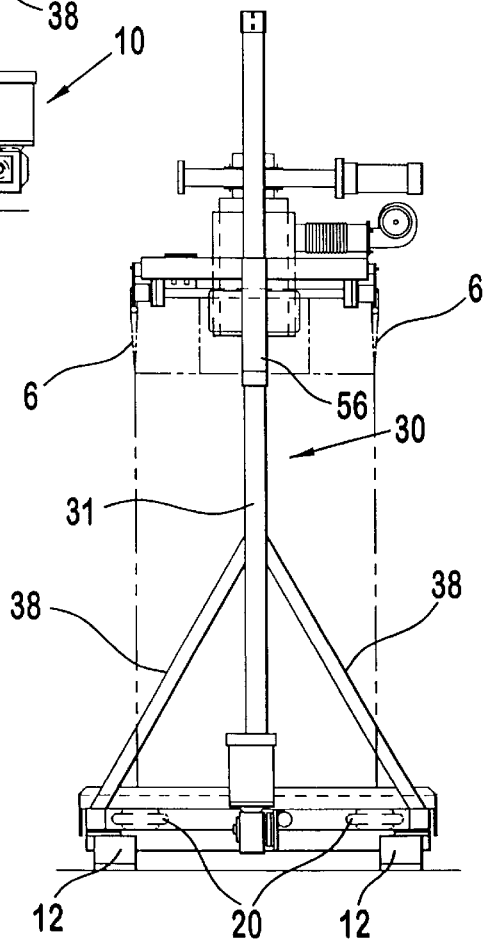
FIG. 2 is a side elevation view of the preferred embodiment.

With reference to FIGS. 1 and 2, each vertical support 30 of bag holder 2 is comprised of a post member 31 which extends vertically from the approximate midpoint of a respective longitudinal frame member 16. Each post 31 has a plurality of apertures 32 beginning at about its midpoint and extending towards the free end thereof. The apertures 32 permit passage of stop pins (not shown) therethrough to define a lower limit to the range of motion of the bag support 50. The vertical posts 31 are supported by bracing members 38 which each extend from the longitudinal frame members 16 at about a forty-five degree angle until they contact the post 31.

Figure 4:
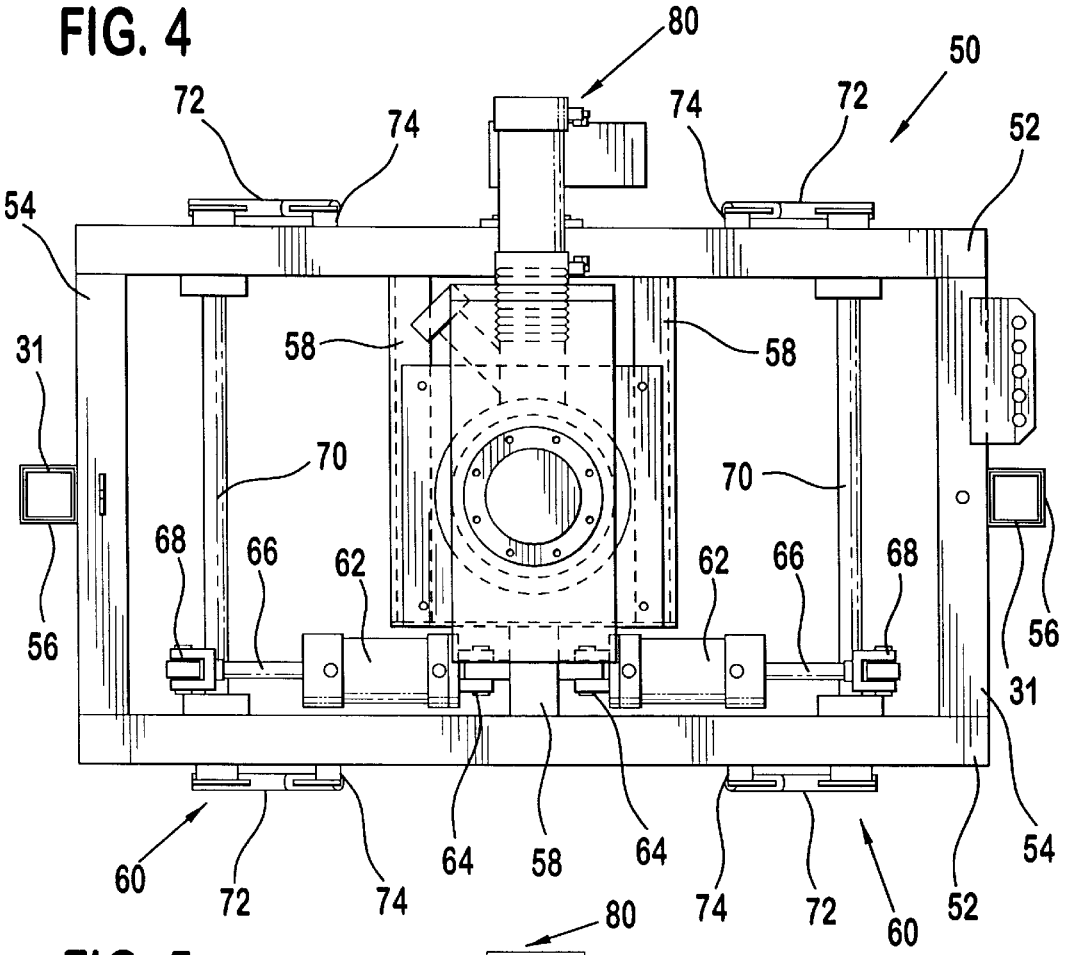
FIG. 4 is a top plan view of the bag support.
Figure 5:
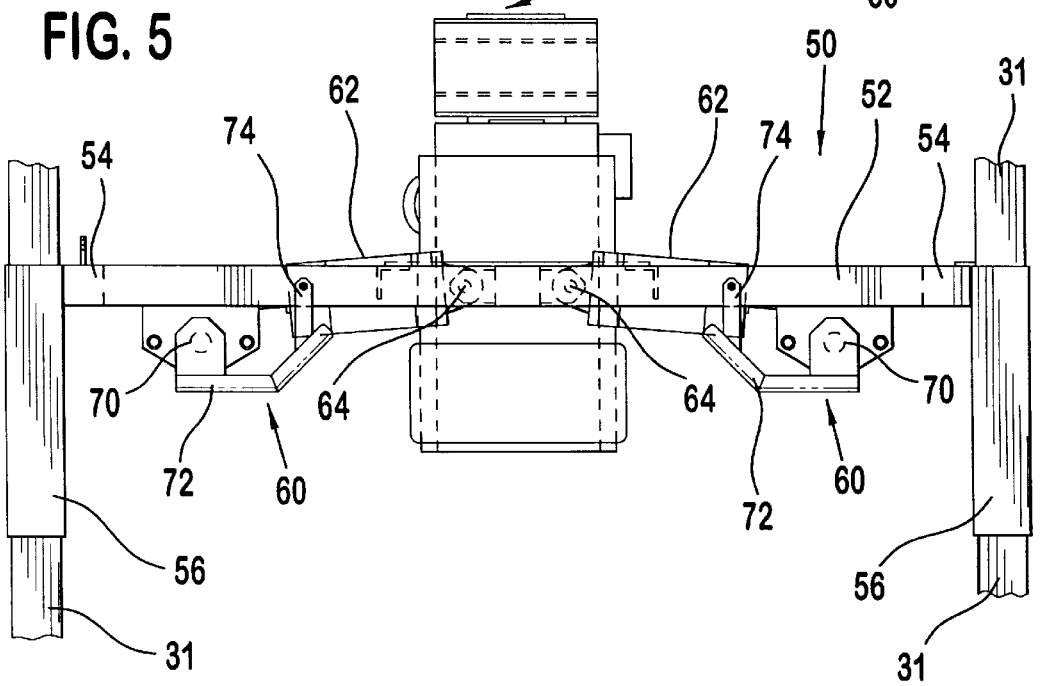
FIG. 5 is a side elevation view of the bag support.

The bag support 50 is shown in FIGS. 4 and 5. The bag support 50 generally comprises longitudinal bag support members 52 and transverse bag support members 54. The bag support 50 may also include a number of filling apparatus support members 58 arranged in various configurations between the longitudinal and transverse bag support members 52, 54. The filling apparatus support members 58 support the bag filling apparatus 80. Any one of a number of various bag filling apparatuses 80 can be used and the configuration of the filling apparatus support members 58 can be adjusted accordingly.

A sleeve 56 is provided perpendicular to each transverse bag support member 54 and is preferably positioned at the midpoint thereof. Each sleeve 56 is dimensioned to fit over and move vertically on a respective post 31. The sleeves 56 guide the vertical movement of the bag support 50. Control of this vertical movement will be described in further detail hereinafter.

The bag support 50 further includes attachment means 60 for attaching a bag 4 (See FIG. 1) thereto. The attachment means 60 can include various means to grasp the bag 4 by its loops or sleeves or the like. The grasping means can be provided in various configurations to correspond to the configuration of the bag loops or sleeves.

The preferred attachment means 60 configuration is shown in FIGS. 4 and 5. In this preferred configuration, the bag support 50 includes two attachment means 60, one on each side of the filling apparatus 80. Each attachment means 60 includes an actuator 62 which is attached at one end by a pivotal mount 64 to the support members 58. The other end of the actuator 62 includes a shaft 66 which extends therefrom and attaches to a pivotal linkage 68. The pivotal linkage 68 interconnects the shaft 66 to a transverse axle 70 which extends between the two longitudinal bag support members 52. Each end of the transverse axle 70 is interconnected with a hook member 72. Activation of the actuator 62 pivots the hook members 72 between open and closed positions. In the closed position, each hook member 72 is positioned adjacent to a clasp member 74 which prevents inadvertent release of a bag loop 6 from hook 72. The actuators 62 are preferably controlled by fluid actuation.

As can be seen in FIG. 4, the four hooks 72 of the bag support 50 are positioned proximate to the four corners thereof. With the vertical posts 31 extending at approximately the mid point of the transverse bag support members 54, the hook members 72 are spaced from the post 31 and are generally accessible by an operator moving about the bag holder 2.

Figure 6:
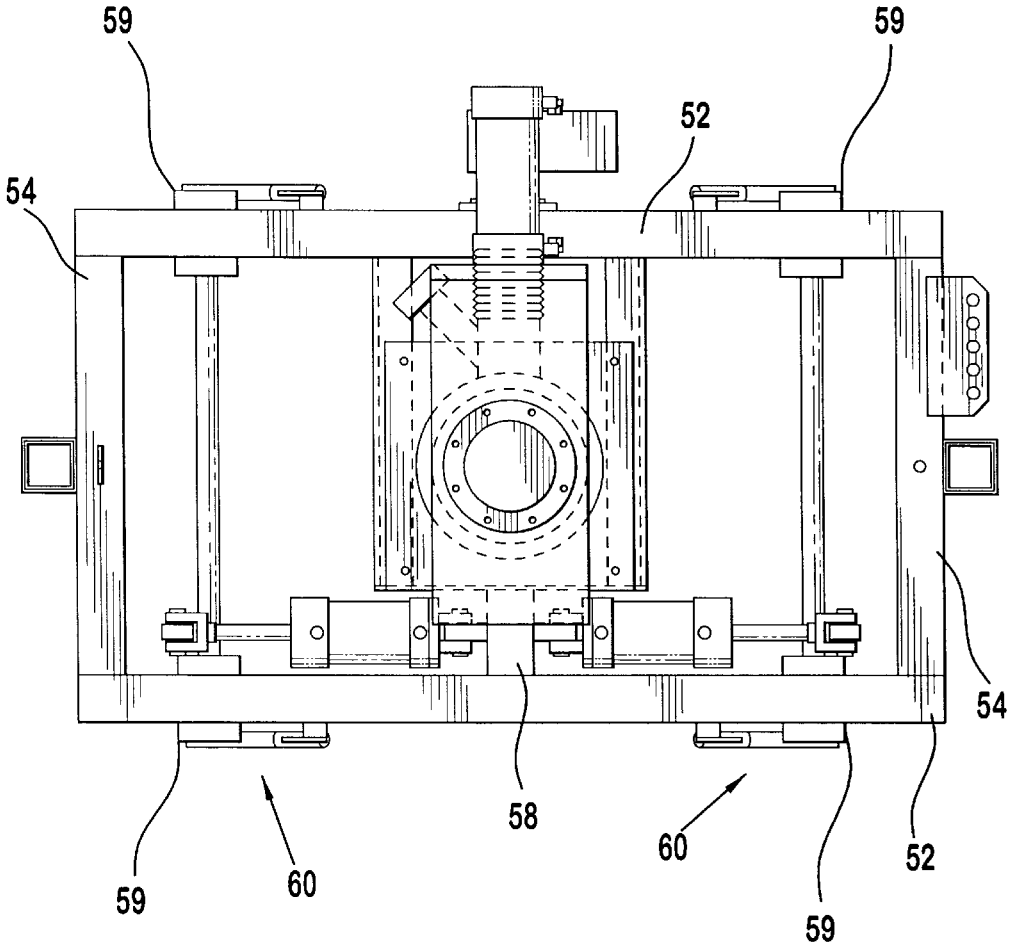
FIG. 6 is a top plan view of an alternative embodiment of the bag support.
Figure 7:
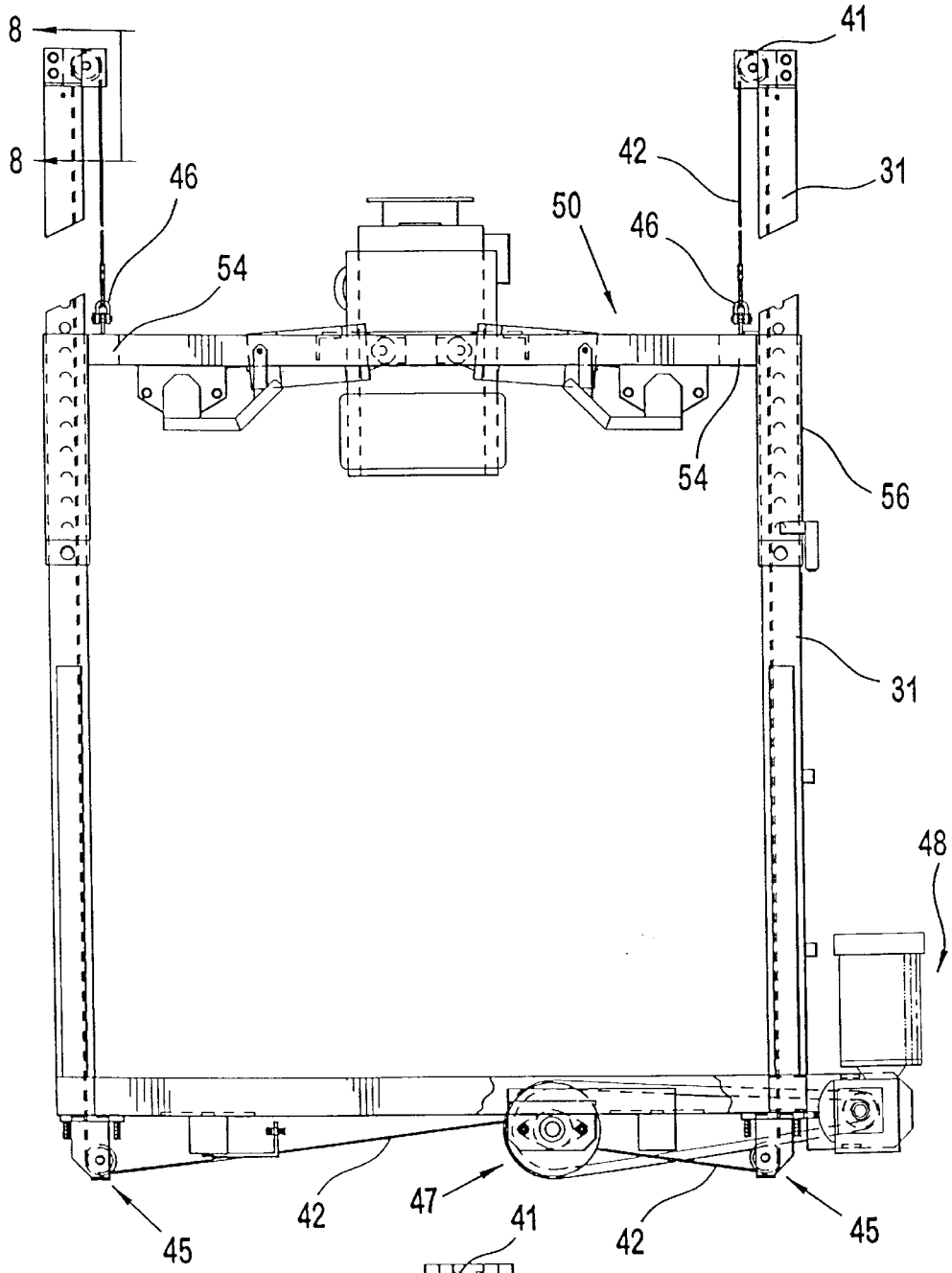
FIG. 7 is a partial elevation view of the bag holder showing the cable assembly.
Figure 8:
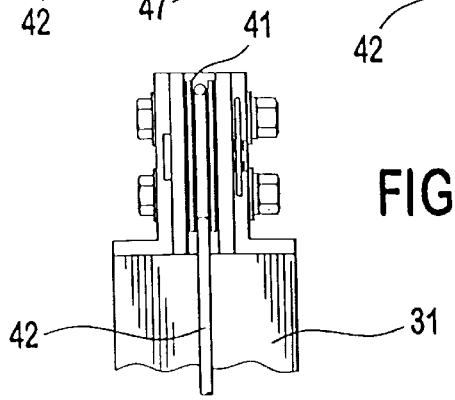
FIG. 8 is an elevation view taken along the line 8—8 in FIG. 7.

In the alternate embodiment shown in FIG. 6, the attachment means 60 are not connected directly to support members 52, 54 and 58. Instead, load cells 59 are positioned between the bag support 50 and the attachment means 60. The load cells 59 measure the weight of the bag 4 and attachment means 60 when the bag 4 is in a suspended position. The weight of the bag 4 can then be determined by subtracting the weight of the attachment means 60 from the weight determined by the load cells 59. This is preferred in hang filling applications wherein the bag 4 is suspended during filling The preferred method of controlling movement of the bag support 50 will be described with reference to FIGS. 7 and 8. The bag support 50 is raised and lowered using a cable assembly 40. The assembly 40 includes a cable 42 which is connected at one end to a connection means 46 attached to the transverse bag support member 54. The cable 42 extends up and around a pulley 41 positioned proximate to the top of the post 31, down through the post 31, through a pulley assembly 45 and to a take-up assembly 47 associated with drive mechanism 48. The pulley and take-up assemblies 45, 47 are preferably configured such that the cables 42 extending from both sides of the bag holder 2 can be simultaneously controlled by a single drive mechanism 48. The drive mechanism 48 preferably includes a motor, but can be any desired drive means including an electric motor, a hand crank, a powered winch or the like.

In the preferred embodiment, the drive mechanism 48 is activated to control the supply of cable 42 to position the bag support 50 in various positions. First, the bag support 50 is lowered to a height which is comfortable for the operator to connect the bag loops 6 and the bag inlet spout. Once connected, the bag support 50 is moved to the proper height for bag filling. The height will depend on the size of the bag 4 , the length of the loops 6, and whether the bag 4 will be suspended during filling or rest on the platform 26. After the bag 4 is filled, the drive mechanism is lowered to provide slack in the loops 6. Once the loops 6 are slacked, the attachment means 60 is activated to release the loops 6 and the inlet spout is automatically released from the filling apparatus 80. Once the bag 4 is released, the bag support 50 is raised to a position which does not encumber removal of the bag 4 from the bag holder 2.

The cable assembly 40 may also be used to tamp the bag 4 during or after filling of the bag 4. This is achieved by cycling the drive mechanism 48 to quickly raise and lower the bag support 50 to tamp the bag 4 against the pallet 15 or platform 26.

It is understood that the movement of the bag support 50 may be controlled by other means, including the use of hydraulics, pneumatics, screw drives, manual manipulation or other similar means.

We claim:

1. A bulk bag filling apparatus comprising:

a base assembly;

a pair of vertical posts extending from the base assembly;

a bag support assembly including two longitudinal frame members connected to two transverse frame members to define a generally rectangular frame assembly that defines four spaced apart comers and a perimeter for the bag support assembly, each transverse frame member including first and second ends and a substantially middle point therebetween;

a bag filling head supported by the bag support assembly within its perimeter;

four rotatable hook members, each hook member supported proximate to a respective corner of the frame assembly and adjacent the bag support assembly perimeter and associated with an actuator assembly which moves it between open and closed positions; and a post engaging sleeve positioned along each transverse frame member at a position proximate its middle point and configured for movement along a respective post for controlled positioning of the support frame, bag filling head and hook members relative to the base assembly.

2. The bag filling apparatus of claim 1, wherein movement of the bag support assembly is controlled by a drive mechanism.

3. The bag filling apparatus of claim 2 further comprising a cable assembly including a cable supply which is connected at a first end to the bag support and associated at a second end with the drive mechanism such that the drive mechanism controls movement of the bag support by varying the amount of cable supplied.

4. The bag filling apparatus of claim 2 further comprising a support platform adjacent the base assembly, the bag support assembly having a fill position at a given height above the platform equal to or greater than an extended length of a bag positioned to be filled, the bag filling apparatus further comprising means for selectively activating and deactivating the drive mechanism to cyclically move the bag support assembly such that the bag to be filled moves between a position spaced from the platform and a position in contact with the platform.

5. The bag filling apparatus of claim 1 further comprising a support platform adjacent the base assembly, the bag support assembly having a fill position at a given height above the platform greater than an extended length of a bag positioned to be filled such that the bag to be filled is spaced from the platform during filling.

6. The bag filling apparatus of claim 5 further comprising means for moving the platform against the bag during filling to cause compaction of material within the bag.

7. The bag filling apparatus of claim 5 wherein load cells are positioned between the hook members and the bag support assembly.

8. The bag filling apparatus of claim 1 further comprising a bag support control assembly including:

a drive mechanism;

a cable; and connectors for attaching the cable to the bag support and the drive mechanism whereby activation of the drive mechanism results in movement of the bag support along the posts.

* * * * *